US011737523B2

(12) United States Patent
Chou

(10) Patent No.: US 11,737,523 B2
(45) Date of Patent: Aug. 29, 2023

(54) FABRIC HAVING RESTRAINING FUNCTION

(71) Applicants: Chao-Mu Chou, Taipei (TW); Shiu-Yin Cheng, Taoyuan (TW)

(72) Inventor: Chao-Mu Chou, Taipei (TW)

(73) Assignees: Chao-Mu Chou, Taipei (TW); Shiu-Yin Cheng, Taoyuan (TW)

( * ) Notice: Subject to any disclaimer, the term of this patent is extended or adjusted under 35 U.S.C. 154(b) by 311 days.

(21) Appl. No.: 17/122,395

(22) Filed: Dec. 15, 2020

(65) Prior Publication Data

US 2021/0204660 A1 Jul. 8, 2021

(30) Foreign Application Priority Data

Jan. 2, 2020 (TW) ..... 109100003
Nov. 18, 2020 (TW) ..... 109140226

(51) Int. Cl.
*A44B 18/00* (2006.01)

(52) U.S. Cl.
CPC ..... *A44B 18/0042* (2013.01); *A44B 18/008* (2013.01); *A44B 18/0019* (2013.01); *A44B 18/0065* (2013.01); *D10B 2501/0632* (2013.01)

(58) Field of Classification Search
None
See application file for complete search history.

(56) References Cited

U.S. PATENT DOCUMENTS 8,551,596 B2 10/2013 Chou
2018/0073169 A1 3/2018 Chou
2018/0140057 A1* 5/2018 Kopanski ..... B29C 65/7802

FOREIGN PATENT DOCUMENTS

TW I559862 12/2016

* cited by examiner

*Primary Examiner* — Alexander S Thomas
(74) *Attorney, Agent, or Firm* — GUICE PATENTS PLLC

(57) ABSTRACT

A fabric having a restraining function is fabricated through at least one yarn having thermoplastic fibers, at least one surface of the fabric has hairiness formed with a plurality of thermoplastic hairs, wherein a first restraining hair having a distal end formed with a spherical member and/or a columnar member is formed through at least a part of the thermoplastic hairs, second restraining hair having a distal end formed with an irregular deformed member is formed through at least a part of the first restraining hairs, so that the at least one surface of the fabric is able to provide a restraining function in a horizontal direction and in a vertical direction to a plurality of fibriform loops.

14 Claims, 6 Drawing Sheets

FABRIC HAVING RESTRAINING FUNCTION

BACKGROUND OF THE INVENTION

1. Field of the Invention

The present invention relates to a fabric, especially to a fabric having a restraining function.

2. Description of Related Art

Conventional fastening fabric can be seen in Taiwan Pat. No. I388291 (equivalent to U.S. Pat. No. 8,551,596), Taiwan Pat. No. 1559862, U.S. Patent application Ser. No. 15/690,799 and Taiwan Patent application Ser. No. 106101627 which are granted and/or applied by the applicant of the present invention; the patents and the applications have disclosed a restraining fabric processed with a singeing process to have a plurality of restraining fibers having curved and/or spherical distal ends. As the sizes of the spherical distal ends of the restraining fibers are very small, and each spherical distal end is formed with a smoother surface, therefore a terry fabric correspondingly tangled with the restraining fabric would be easily loosened due to a phenomenon that only a restraining function in a horizontal direction is provided, and there is a lack of restraining function in the vertical direction. As such, when the fastening fabric is applied as a bandage, it has a shortage that the distal ends of the bandage are easily loosened especially in a water contained status.

As for a conventional hook and loop fastener, the hook members are fabricated through thick fibers and the distal ends thereof are basically uniformly formed in a hook-like or mushroom-like shape, and distributed uniformly. As the fiber having the size larger than 300d/f is adopted as the hook element, thus the hook and loop fastener can only be applied as a buckling member, but not a functional product capable of being in contact with skins, for example being applied as a bandage; when the hook and loop fastener is applied for providing an adhering function to a garment, the garment or skins may be damaged; accordingly, the above-mentioned shortages shall be overcome.

SUMMARY OF THE INVENTION

One primary objective of the present invention is to provide a fabric having a restraining function, at least one surface of the fabric having hairiness has restraining hairs each having a distal end formed with an irregular deformed member, thereby allowing the fabric to be provided with a restraining function in a vertical direction to a terry fabric having fibriform loops.

Another objective of the present invention is to provide a fabric having a restraining function, a front surface and a rear surface of the fabric having hairiness respectively have restraining hairs each having a distal end formed with an irregular deformed member and fibriform loops, thereby allowing the front surface and the rear surface of the fabric to be provided with a mutual retraining function in a vertical direction.

Another objective of the present invention is to provide a fabric having a restraining function, a front surface and a rear surface of the fabric are provided with a mutual retraining function in a vertical direction, and sizes of restraining fibers are smaller than 6 d/f, thereby suitable to be directly applied as a bandage with a concern of hurting skins.

Another objective of the present invention is to provide a fabric having a restraining function, wherein at least a part of irregular deformed members are formed through a plurality of spherical members and/or columnar members being heated, melted to be cohered.

One another objective of the present invention is to provide a fabric having a restraining function, at least one surface of the fabric having hairiness has restraining hairs each having a distal end formed with an irregular deformed member, because the restraining hair having the distal end formed with irregular deformed member increases an original area of a restraining fiber, thereby being able to be mutually tangled with a fibriform loop structure fabricated through conventional fibers, and not limited to a terry fabric fabricated through microfibers.

For achieving said objective, one technical solution provided by the present invention is to provide a fabric having a restraining function, which is fabricated through at least one yarn having thermoplastic fibers, at least one surface of the fabric having hairiness is formed with a plurality of thermoplastic hairs, wherein a first restraining hair having a distal end formed with a spherical member and/or a columnar member is formed through at least a part of the thermoplastic hairs; and characterized in that: a second restraining hair having a distal end formed with an irregular deformed member is formed through at least a part of the first restraining hairs, so that the at least one surface of the fabric is able to provide a restraining function in a horizontal direction and in a vertical direction to a plurality of fibriform loops.

According to one embodiment, the at least one surface of the fabric is processed with a raising finishing process, including a peaching process and/or a brushing process, for forming the thermoplastic hairs.

According to one embodiment, the first restraining hairs having distal ends formed with the spherical member and/or the columnar members are formed through the thermoplastic hairs being processed with a singeing process; and the second restraining hairs having the distal ends formed with the irregular deformed members are formed through at least a part of the first restraining hairs being processed with a thermal melting and pressing procedure.

According to one embodiment, the size of the thermoplastic fibers is smaller than 6 deniers.

According to one embodiment, the fabric is made from woven fabrics having plain, twill or spacer structures; or the fabric is made from knitted fabrics having single-surface, double-surface or spacer structures.

According to one embodiment, the thermoplastic hairs are fabricated through hairs from staple yarns being processed with a spinning process; or a raising finishing process, including a peaching process and/or a brushing process, is processed when necessary for fabricating more of the thermoplastic hairs.

According to one embodiment, the thermoplastic hairs are formed through a plurality of loops erected on the at least one surface of the fabric being processed with a shearing process.

According to one embodiment, the at least one yarn having the thermoplastic fibers has an elastic filament arranged in a warp direction and/or a weft direction, thereby being provided with elasticity.

According to one embodiment, the yarn having the thermoplastic fibers can be filament yarns or staple yarns made of polyolefin, polyamide, or polyester.

According to one embodiment, the fabric and another fabric having the correspondingly-tangled fibriform loops are adhered with a back to back means, so that two opposite surface of the adhered fabric are provided with a mutual tangling function.

According to one embodiment, an elastic member is inserted and adhered between the fabric and another fabric, thereby forming a fabric combination.

According to one embodiment, one surface of the fabric having hairiness has the second restraining hairs having the distal ends formed with the irregular deformed members, and another surface of the fabric has the fibriform loops, so that the two surfaces of the fabric are provided with a mutual tangling function.

According to one embodiment, the fibriform loops are made from air texture yarns, draw texture yarns or differential shrinkage microfiber yarns.

According to one embodiment, the irregular deformed member is formed through a plurality of the spherical members and/or the columnar members being heated and melted so as to be cohered.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
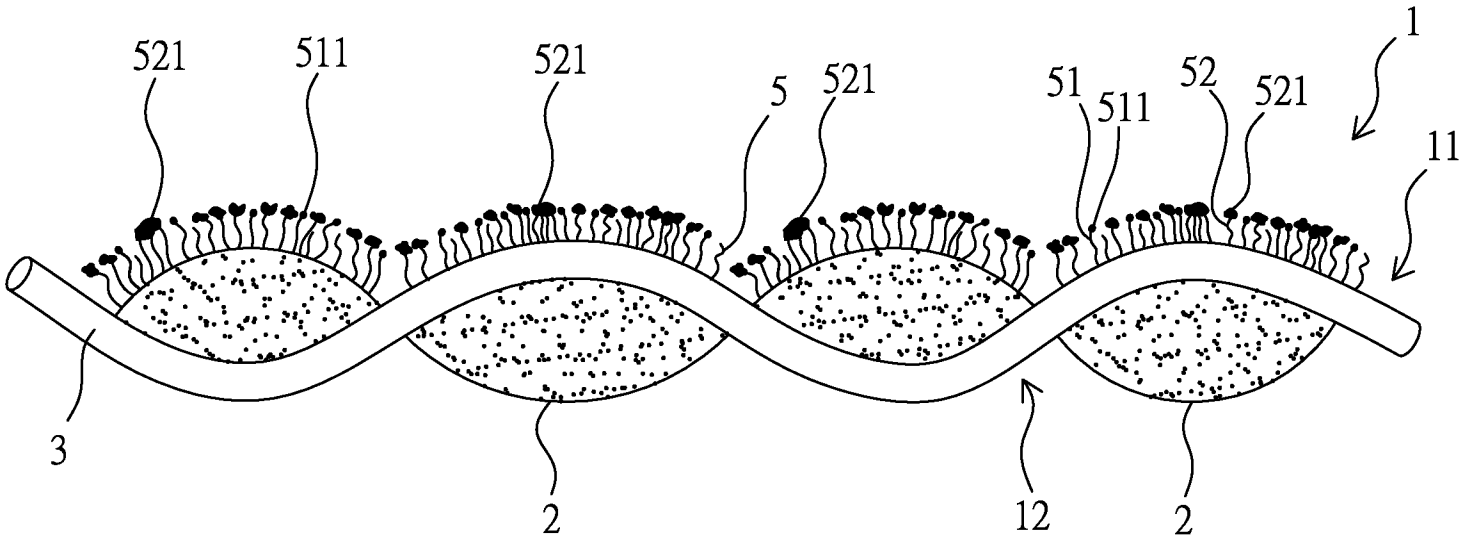
FIG. 1 is a cross sectional view illustrating a first embodiment of a fabric having a restraining function according to the present invention, wherein a woven plain fabric being adopted as the fabric and one surface thereof being provided with thermoplastic hairs, first restraining hairs and second restraining hairs.
Figure 2A:
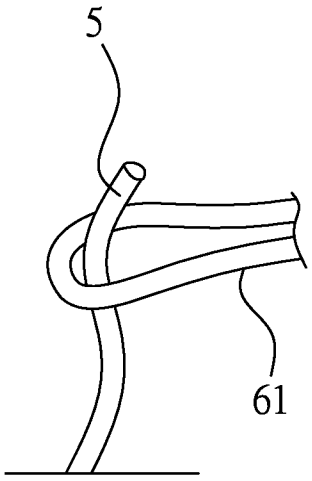
FIG. 2*a* is an enlarged schematic view illustrating the thermoplastic hairs, the first restraining hairs and the second restraining hairs being tangled with the fibriform loops.
Figure 2B:
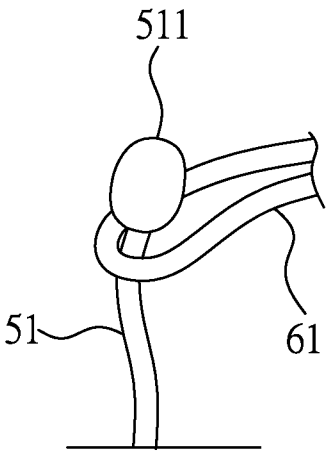
FIG. 2*b* is another enlarged schematic view illustrating the thermoplastic hairs, the first restraining hairs and the second restraining hairs being tangled with the fibriform loops.

Please refer from FIG. 1 to FIG. 2*b*, which are cross sectional views illustrating a fabric 1 having a restraining function according to a first embodiment of the present invention. The fabric 1 is a woven plain structure having a front surface 11 and a rear surface 12 opposite to the front surface 11, and the fabric 1 is formed through being fabricated by utilizing warp yarns 2 and/or weft yarns 3. When thermoplastic filament yarns are adopted as the warp yarns 2 and the weft yarns 3, a raising finishing process is required for allowing the front surface 11 of the fabric 1 to have hairiness formed with a plurality of thermoplastic hairs 5.

Wherein, the raising finishing process includes a peaching process and/or a brushing process, and a shearing process can be processed when necessary for allowing lengths of the thermoplastic hairs 5 to be provided with the uniformity. Moreover, the thermoplastic filament yarns can be draw texture yarns (DTY) made of polyester, polyolefin or polyamide, or can be air texture yarns (ATY) made of polyester, polyolefin or polyamide; or can be staple yarns made of polyester, polyolefin or polyamide, for example ring spinning; and the raising finishing process can be determined whether being processed with respect to the amounts of the thermoplastic hairs 5 of the yarn.

Please refer to FIG. 1, the rear surface 12 is not processed with the raising finishing process, so that the rear surface 12 is not provided with the thermoplastic hairs 5.

Figure 2C:
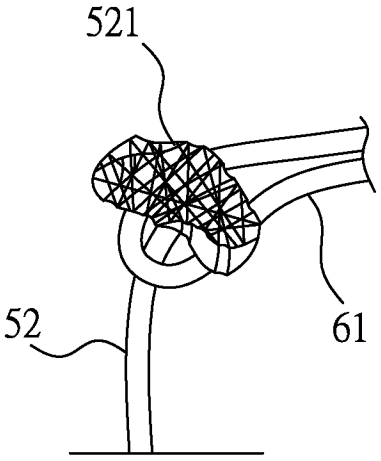
FIG. 2*c* is another enlarged schematic view illustrating the thermoplastic hairs, the first restraining hairs and the second restraining hairs being tangled with the fibriform loops.
Figure 2D:
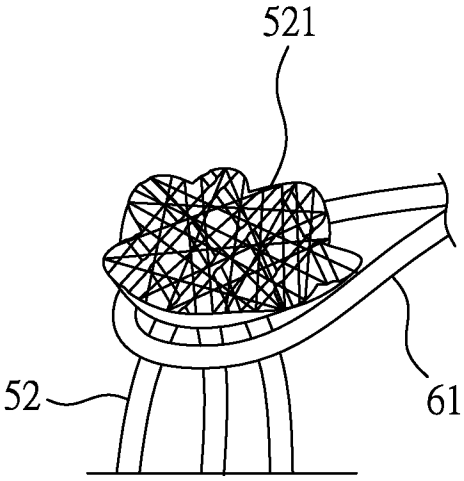
FIG. 2*d* is one another enlarged schematic view illustrating the thermoplastic hairs, the first restraining hairs and the second restraining hairs being tangled with the fibriform loops.

The fabric 1 is processed with a singeing process, so that distal ends of at least a part of the thermoplastic hairs 5 can be melted and cohered to form a plurality of first restraining hairs 51 (as shown in FIG. 2*b*) having a spherical member and/or a columnar member 511 with a smooth surface; then a thermal melting and pressing process is processed for allowing the spherical member and/or the columnar member 511 of the at least a part of the first restraining hairs 51 to be further heated, melted and pressed to form a plurality of second restraining hairs 52 (as shown in FIG. 2*c* and FIG. 2*d*) having an irregular deformed member 521. Wherein, the spherical member and/or the columnar member 511 is heated, melted and pressed so as to be cohered for forming the irregular deformed member 521 having a greater volume. As such, fibriform loops tangled by the irregular deformed member 521 of the second restraining hairs 52 are not easily to be loosened, thus the fabric 1 is provided with a better restraining function to the fibriform loops of a terry fabric. As such, under a situation of the fabric 1 containing water, the second restraining hair 52 has a better restraining function in a horizontal direction and in a vertical direction than the first restraining hair 51.

A terry fabric 6 (known as a prior art therefore not shown in figures) mutually tangled with the fabric 1 having the restraining function is defined as that at least one surface of the terry fabric having a plurality of fibriform loops 61 (as shown from FIG. 2*a* to FIG. 2*d*), the fibriform loops 61 can be formed through the yarn itself, for example the air texture yarn (ATY) having a surface with compact fibriform loops, draw texture yarn (DTY) having loose and curved fibers or two-component curved elastic yarn (for example T400® fibers fabricated by the INVISTA); loose microfiber fibriform loops fabricated through differential shrinkage microfiber yarn sustaining a heating effect; or forming loosen yarn loops on a surface of the fabric with a weaving means of a terry fabric, the loosen yarn loop itself has the loosen fibriform loops; the weaving or knitting fabric has less interweaving points for allowing the surface of the fabric to form loosen floating yarns, and the loose floating yarns is able to release loose fibriform loops; or fibriform loops fabricated by melt spinning or electrospinning; the aforesaid texture structure can all be adopted as the terry fabric.

Moreover, a surface density of the fibriform loops 61 on the terry fabric can be increased through an elastic retracting effect of the elastic filament, so that the fibriform loops 61 are provided with effects of being more loosened and erecting from the surface of the terry fabric, for example the yarns with the elastic filament as a core, or allowing the elastic filament to be directly woven therein, but what shall be addressed is that the fibriform loops 61 of the terry fabric are known prior arts, therefor no further illustration is provided.

Please refer to FIG. 2*a*, FIG. 2*b*, FIG. 2*c*, and FIG. 2*d*, which are enlarged schematic views illustrating the thermoplastic hairs 5, the first restraining hair 51 having the distal end formed with the spherical member and/or the columnar member 511 and the second restraining hair 52 having the distal end formed with the irregular deformed member 521 being mutually tangled with the fibriform loops 61. As shown in FIG. 2*a*, the thermoplastic hair 5 is processed with the singeing process for allowing the distal ends thereof to be naturally melted and cohered to form the first restraining hair 51 having the spherical member and/or the columnar member 511 (as shown in FIG. 2*b*)

Because conventional fibers used in general clothes are adopted as the fibers of the fabric 1, for example the size of fibriform can be from 1 d/f to 10 d/f, but preferably to be smaller than 6 d/f, and the size is obviously smaller than the size of the filament with 300 d/f adopted in a hooking element of a conventional hook and loop fastener. According to this embodiment, the distal ends of the first restraining hairs 51 are formed with the spherical members and/or the columnar members 511, thus a restraining function provided to the fibriform loops 61 is relatively poor, especially the restraining function in the vertical direction; accordingly, in some applications, for example a tail end of a bandage is not provided with a sufficient adhering force thereby being easily to be loosened, and the restraining function cannot be provided under a status of containing moisture.

The first restraining hair 51 is processed with a thermal melting and pressing process, so that the spherical member and/or the columnar member 511 can be further melted, pressed and deformed, thereby forming a second restraining hair 52 having an irregular deformed member 521 (as shown in FIG. 2*c*); the irregular deformed member 521 is formed through the ambient texture patterns and fibers thereof being pressed and molded under a situation of the spherical member and/or the columnar member 511 being in a melted and soften status, in other words random texture patterns and a three dimensional space formed through the fibers being staggeringly distributed are pressed and molded for forming the second restraining hairs 52 having the irregular deformed members 521 with various shapes.

A surface area of the spherical member and/or the columnar member 511 of the first restraining hair 51 is enlarged through the thermal melting and pressing process, and the appearance thereof and the orientation thereof are also altered. In other words, the spherical members and/or the columnar members 511 of most of the first restraining hairs 51 are formed along the original direction of the thermoplastic hairs 5, the irregular deformed members 521 at the distal ends of the second restraining hairs 52 are not only flattened, but also squeezed and bent through the above-mentioned texture patterns and the three dimensional space formed through the fibers being staggeringly distributed, so that the second restraining hairs 52 are distributed in a random means, and no certain direction effect is provided, thus the second restraining hair 52 is able to tangle the fibriform loops 61 having regularity and able to tangle the fibriform loops 61 without the regularity.

Moreover, because the irregular deformed member 521 is formed through the spherical member and/or the columnar member 511 being pressed and molded by the texture patterns of the fabric 1 and the fibers thereof, during the thermal melting and pressing process, at least a part of the irregular deformed members 521 are formed through the spherical members and/or the columnar members 511 being heated, melted so as to be cohered (as shown in FIG. 2*d*), thus the volume and the area of the irregular deformed member 521 are further enlarged, and fibriform having thicker size can be adopted as the fibriform loops 61 which is correspondingly tangled.

The above-mentioned thermal melting and pressing process is to utilize a heating and contact pressing device to allow at least a part of the first restraining hairs 51 having the spherical members and/or the columnar members 511 to be softened, then be pressed to form the second restraining hairs 52 having the irregular deformed members 521. The heating and pressing device can be a sublimation paper printing machine or a similar mechanism, the heating and contact pressing device have a heating roller and a pressing circulation belt, the fabric 1 is fed between the heating roller and the pressing circulation belt for being processed with the continuous thermal melting and pressing process. After the sublimation paper printing machine is utilized for processing the thermal melting and pressing process, the irregular deformed member 521 is formed with a rough surface.

If a non-continuous thermal melting and pressing process is desired to be processed, a heating plate and a pad are adopted for replacing the heating and contact pressing device, the fabric 1 is disposed between the heating plate and the pad for being processed with the non-continuous thermal melting and pressing process. Wherein, at least one piece of paper can be disposed between the fabric 1 and the heating plate for preventing the fabric 1 being polluted by residual colors of the previous fabric; if a sublimation paper is fed, a thermal melting and pressing combination condition is properly adjusted for allowing the pattern printing and the melting and pressing process to be simultaneously finished, thereby saving cost.

A range of the thermal melting and pressing combination condition is determined with respect to the fiber material, structures, and the type of the heating and contact pressing device, and there is no certain limitation for the selectable temperature, pressure and time as long as the texture property of the fabric is not damaged, so that at least a part of the first restraining hairs 51 having the spherical members and/or the columnar members 511 can be pressed to form the second restraining hairs 52 having the irregular deformed members 521, for example the fabric 1 is polyethylene fibers, and the thermal melting and pressing combination condition of temperature, pressure and time is much lower than that of polyamide, and the thermal melting and pressing combination condition of the polyamide is slightly lower than that of polyester.

Moreover, the thickness of the fabric 1 also affects the melting and pressing effect, so that the thermal melting and pressing condition is required to be modified with respect to the structure of the fabric 1, for example the weaving plain fabric 1 is thinner and more compact than that of a conventional terry fabric, thus the pressure, the time and the temperature applied to the thermal melting and pressing process disclosed in the first embodiment can be smaller than those applied to the thicker terry fabric. The materials of the thermoplastic fibers of the fabric having the restraining function can be thermoplastic filament yarns, for example polyethylene, polypropylene, polyamide or polyester, but not limited thereto.

Under a situation of the ambient fibers being in an irregular status and the pressing effect applied to the structural patterns of the fabric, most of the irregular deformed members 521 of the second restraining hairs 52 are bent and pressed for being in an irregular sheet-like shape. Comparing the irregular deformed member 521 and the spherical member and/or the columnar member 511 of the first restraining hair 51, the surface area of the irregular deformed member 521 is greater than that of the spherical member and/or the columnar member 511, thus it is obvious that the restraining function of the irregular deformed member 521 is better than that of the spherical member and/or the columnar member 511, especially in the vertical restraining function in a moisture environment.

The spherical members and/or the columnar members 511 of the first restraining hairs 51 mainly provide the restraining function in the horizontal direction, because the second restraining hairs 52 have the irregular deformed members 521, the second restraining hairs 52 can not only provide the restraining function in the horizontal direction, but also provide the restraining and hooking function in the vertical direction.

Moreover, the surface area of the irregular deformed member 521 is greater than that of the spherical member and/or the columnar member 511, thus thicker fibriform can be adopted as the fibriform loops 61, the size of the thermoplastic filament yarn used for restraining is 3.125 d/f, thus thinner fibriform or conventional fibriform with substantial equal or thicker size can be adopted as the fibriform loops 61; as such, a shortage of a loop member of a conventional hook and loop fabric being required to be smaller than the hook member used for restraining is solved, and the selectable range of the size of the fibriform loop can be enlarged. Especially, the production process of the conventional fiber is simpler than that of the microfiber, and the conventional fiber has advantages of being more durable and environmental friendly, for example the microfiber is very likely to be cracked while being washed domestically and discharged to the ocean, and eventually returns to our food chain.

Moreover, the amount of the thermoplastic hairs 5 determines the amounts of the first restraining hairs 51, for example more hairs are generated when the raising finishing process is processed for a longer time, the amount of the thermoplastic hairs 5 can also be increased through the thermoplastic staple yarns being processed with the raising finishing process, and the amount of the second restraining hairs 52 is determined by the amount of the first restraining hairs 51; the spherical members and/or the columnar members 511 at the distal ends of the first restraining hairs 51 can be formed with different sizes through different raising and singeing conditions, the spherical member and/or the columnar member 511 having a greater size can be melted and pressed for forming the irregular deformed member 521 having a larger size. As such, through adjusting conditions of the raising finishing process, the singeing process and the thermal melting and pressing process, the restraining function of the fabric 1 having the restraining function applied to the fibriform loops 61 can be correspondingly adjusted, and the size of the fibriform loop 61 which is correspondingly tangled can be selected. The raising finishing process and the singeing process are known as prior arts, therefore no further illustration is provided.

Moreover, the warp yarns 2 and/or the weft yarns 3 can be provided with elastic filaments, the elastic filaments can be yarns having the polyurethane elastic filaments in the core and having under the trademark of Lycra, or the two-components elastic yarn, T400® fibers fabricated by the INVISTA, so that the fabric 1 having the restraining function can be provided with elasticity in warp and weft directions, thus the fabric 1 is able to provide a better tightening function when the fabric 1 is applied as a bandage.

The irregular deformed member 521 of the second restraining hair 52 is not only able to provide the restraining function in the horizontal direction, but also able to provide the restraining and hooking function in the vertical direction; but when the restraining function in the vertical direction is overly large, a problem of the second restraining hairs 52 being falling may cause, so that a back adhesive layer is disposed on the rear surface of the fabric 1 for preventing the second restraining hairs 52 from being released. Wherein, the means of disposing the back adhesive layer is known as a prior art, therefor no further illustration is provided.

Figure 3:
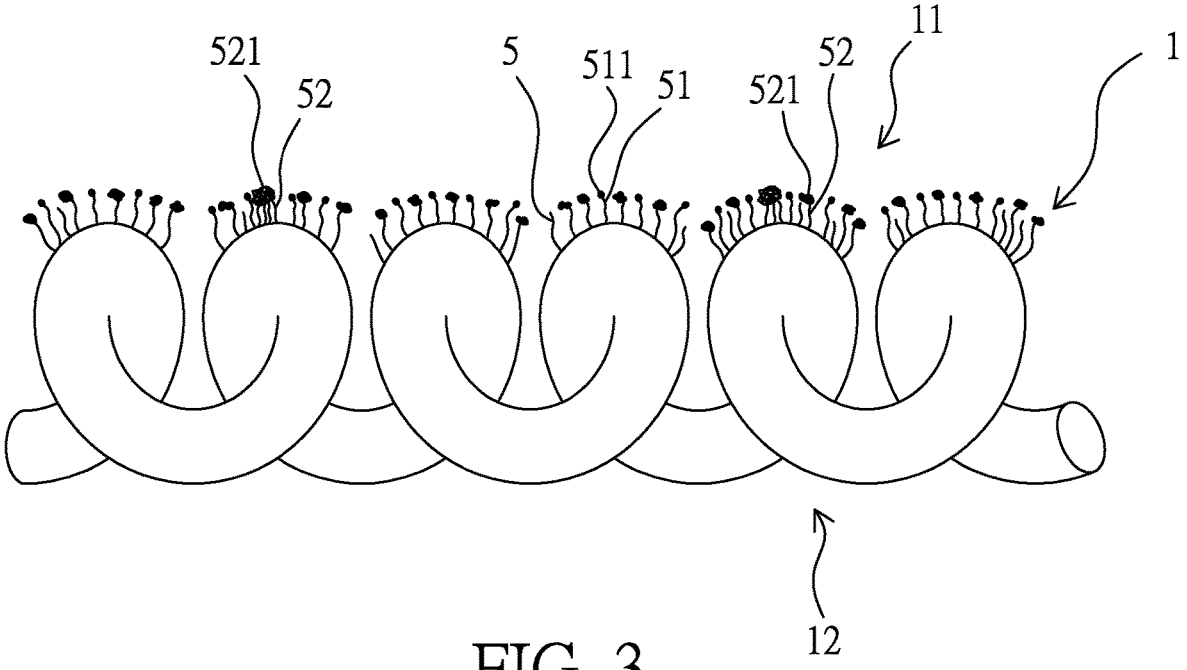
FIG. 3 is a schematic view illustrating a second embodiment of the fabric having the restraining function according the present invention, wherein a warp or weft knitted plain single-surface fabric being adopted as the fabric and one surface thereof being provided with thermoplastic hairs, first restraining hairs and second restraining hairs.

Please refer to FIG. 3, which discloses a cross sectional illustrating a second embodiment of the fabric having the restraining function according the present invention. According to this embodiment, the fabric 1 is a knitting fabric such as a single jersey or a tricot, and has a front surface 11 and a rear surface 12. The fabric 1 is fabricated through the thermoplastic filament yarns containing materials of polyester, polyolefin or polyamide, the draw texture yarns having the size of 75 d/36 f, 150 d/36 f or 150 d/48 f, or containing elastic filaments, so that the fabric 1 is provided with the elasticity in the warp and the weft directions, the elastic filaments can be yarns having polyurethane elastic filaments in the core, thereby preventing the elastic filaments from being broken during the brushing process.

The fabric 1 is processed with the raising finishing process, for example the peaching and/or the brushing process, for allowing the front surface 11 of the fabric 1 to have hairiness formed with a plurality of the thermoplastic hairs 5. Then, the singeing process is processed for allowing distal ends of at least a part of the thermoplastic hairs 5 to be respectively melted and cohered to form a plurality of the first restraining hairs 51 have the spherical member and/or the columnar member 511. Lastly, the thermal melting and pressing process is processed for allowing at least of a part of the spherical members and/or the columnar members 511 to be pressed and molded for forming a plurality of the second restraining hairs 52 having the irregular deformed member 521, so that the irregular deformed member 521 is able to generate a restraining function with a plurality of the fibriform loops 61.

When necessary, the fabric 1 can be adhered with the above-mentioned proper terry fabric, so that the front surface and the rear surface are provided with a mutually restraining function.

Figure 4:
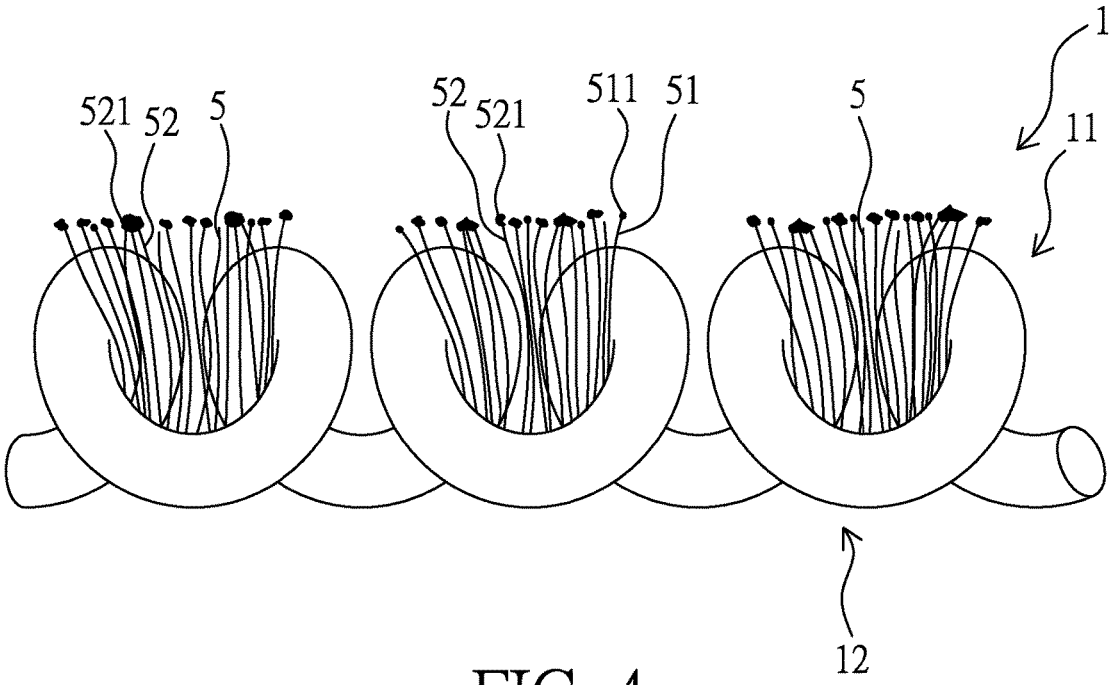
FIG. 4 is a cross sectional view illustrating a third embodiment of the fabric having the restraining function according the present invention, wherein a circular knitted terry fabric being adopted as the fabric and one surface thereof being provided with thermoplastic hairs, first restraining hairs and second restraining hairs.

Please refer to FIG. 4, which discloses a cross sectional view illustrating a third embodiment of the fabric having the restraining function according the present invention. According to this embodiment, the fabric 1 is a circular knitted terry fabric, and has a front surface 11 and a rear surface 12, and the front surface 11 has a plurality of loops. The fabric 1 is fabricated through the thermoplastic filament yarns containing materials of polyester, polyolefin or polyamide, the thermoplastic filament yarn can be thermoplastic fibers such as polyester or Nylon with the size of 75 d/36 f, 150 d/36 f or 150 d/48 f, for example the draw texture yarn, and a shearing process is processed for shearing top ends of the loops, so that the front surface 11 of the fabric 1 has hairiness formed with a plurality of erected thermoplastic hairs. Then, a singeing process is processed for allowing distal ends of at least a part of the thermoplastic hairs 5 to be melted and cohered for forming a plurality of first restraining hairs 51 having a spherical member and/or a columnar member 511. Lastly, a thermal melting and pressing process is processed for allowing at least of a part of the spherical members and/or the columnar members 511 to be pressed and molded for forming a plurality of second restraining hairs 52 having an irregular deformed member 521, so that the irregular deformed member 521 is able to generate a restraining function with a plurality of the fibriform loops 61.

Moreover, the amount of the thermoplastic hairs 5 can be altered through changing the weaving density, so as to adjust an adhering and tangling force used for restraining, thereby providing products with different adhering and tangling forces. When necessary, the structure of the fabric 1 can be added with elastic filaments for allowing the fabric 1 to be provided with elasticity and softness, so that the fabric 1 can be more delicate, and the delicacy can further enhance the restraining function. Because the irregular deformed member 521 is able to greatly increase the retraining strength, the second restraining hairs 52 may be pulled and released by the fibriform loops 61 due to the restraining strength, thus the single-surface terry fabric 1 can be processed with a back adhering process for adhering the second restraining hairs 52. Or, a terry fabric can be selected, in other words the pile yarn, which is derived by shearing the terry fabric, is covered by the base structure yarn, thereby preventing the second restraining hairs 52 from releasing and falling.

Figure 5:
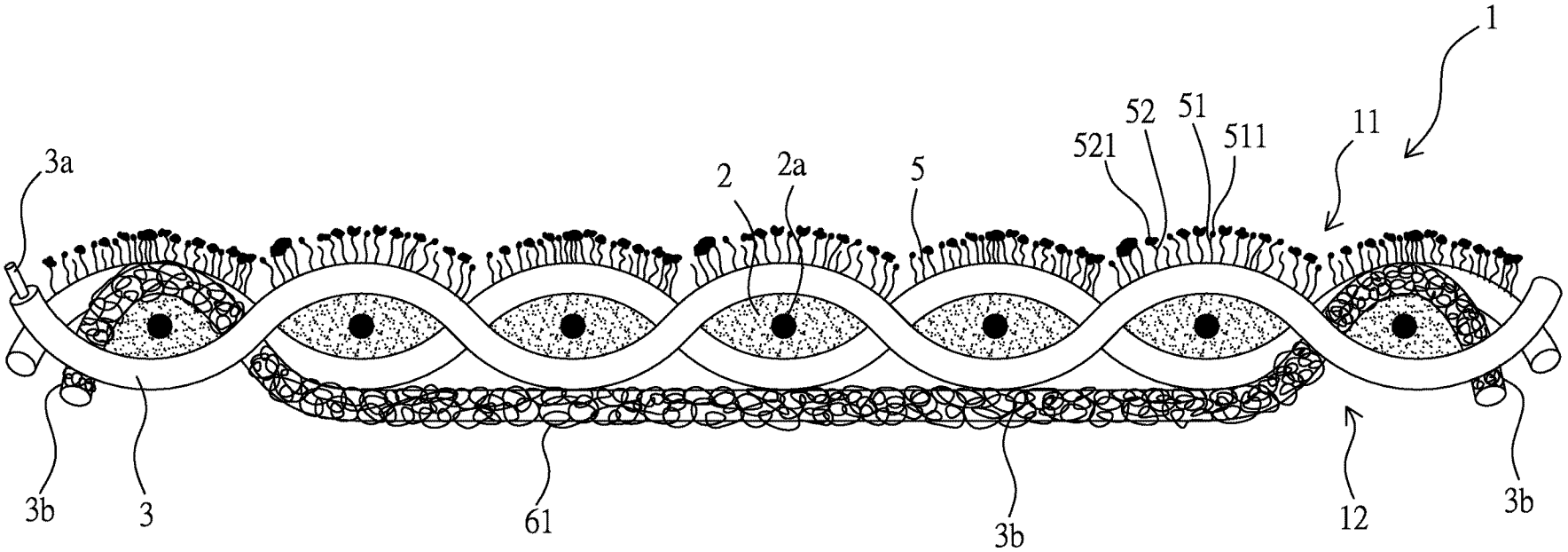
FIG. 5 is a cross sectional view illustrating a fourth embodiment of the fabric having the restraining function according the present invention, wherein a woven fabric being adopted as the fabric and a front surface thereof being provided with thermoplastic hairs, first restraining hairs and second restraining hairs, and a rear surface being provided with the fibriform loops.

Please refer to FIG. 5, which discloses a cross sectional view illustrating a fourth embodiment of the fabric having the restraining function according the present invention. According to this embodiment, the fabric 1 is a woven fabric, and has a front surface 11 and a rear surface 12. This embodiment discloses that the applicable range of the fabric 1 is expanded, and a mutual restraining function is provided when the front surface 11 is in contact with the rear surface 12. According to this embodiment, at least a part of a warp yarn 2 and a weft yarn 3 are fabricated through thermoplastic filament yarns with materials of polyamide or polyester, for example an elastic covered warp yarn 2*a* and an elastic covered weft yarn 3*a* formed through covered polyurethane elastic filaments, so that the fabric 1 is provided with elasticity in the warp and the weft directions.

According to this embodiment, with respect to the elastic strength requirement, the elastic covered warp yarn 2*a* and the elastic covered weft yarn 3*a* can be fully adopted as the warp yarn 2 and the weft yarn 3, or the elastic covered warp yarn 2*a* and the elastic covered weft yarn 3*a* can be partially adopted. The elastic covered warp yarn 2*a* and the elastic covered weft yarn 3*a* are fabricated in a stretched status, after a greige is placed in a machine, the elastic covered warp yarn 2*a* and the elastic covered weft yarn 3*a* are processed with a pre-setting process before being dyed and finished, so that the residual stress generated during the elastic covered warp yarn 2*a* and the elastic covered weft yarn 3*a* being fabricated can be released, and the elasticity of the elastic covered warp yarn 2*a* and that of the elastic covered weft yarn 3*a* can be recovered, the fabric 1, which has been fully retracted, can be stretched again so as to be set, thereby achieving an objective of having required length and width, the fabric 1 is provided with elasticity in the warp and the weft directions, so that a longitudinal deforming problem of having curved edges while being cut in an long strip status can be overcome, and the fabric 1 can be the most material applied as a bandage.

According to this embodiment, the front surface 11 of the fabric 1 is a warp surface, the rear surface 12 is a weft surface, the fabric 1 is mainly fabricated through the elastic covered warp yarn 2*a* and the elastic covered weft yarn 3*a*, so that the fabric 1 is provided with the elasticity in the warp and the weft directions, wherein the front surface 11 is processed with a raising finishing process, for example a peaching process and/or a brushing process, so that the front surface 11 of the fabric 1 has hairiness formed with a plurality of thermoplastic hairs 5. Then, a singeing process is processed for allowing distal ends of at least a part of the thermoplastic hairs 5 to be respectively melted and cohered to form a plurality of the first restraining hairs 51 have a spherical member and/or a columnar member 511. Lastly, a thermal melting and pressing process is processed for allowing at least of a part of the spherical members and/or the columnar members 511 having a smooth surface to be pressed and molded for forming a plurality of second restraining hairs 52 having an irregular deformed member 521.

The weft surface is not only provided with the elastic covered weft yarn 3*a*, a weft yarn 3*b* having a plurality of loose fibriform loops 61 is also provided, the weft yarn 3*b* of the loose fibriform loops 61 can be conventional yarn such as air texture yarn with polyester or polyamide, two-component curved elastic yarn, or draw texture yarn, because the microfiber, for example the microfiber with a size small than 0.25D does not has a good temperature resisting property comparing to the conventional fiber, utilizing the conventional fiber can prevent a situation of melting and felting during the thermal melting and pressing process, thereby preventing the fibriform loops 61 from losing the fluffiness.

With the fluffiness of the weft yarn 3*b*, the elastic covered weft yarn 3*a* on the rear surface 12 is substantially covered or shielded by the weft yarn 3*b* of the loose fibriform loops 61, and the function is that the fluffiness of the fibriform loops 61 of the weft yarn 3*b* can be enhanced after the elastic covered weft yarn 3*a* is elastically retracted, thereby increasing the restraining function of the spherical member and/or the columnar member 511 of the first restraining hair 51 and the irregular deformed member 521 of the second restraining hair 52. The weft yarn 3*b* of the loose fibriform loops 61 is arranged to be distributed at intervals, for example being distributed at every three weft yarns, and the weft yarn 3*b* of the loose fibriform loops 61 has a longer span because of less interweaving points, so as to be shown as floating yarns, for example only one interweaving point at every five warp yarns; with the above-mentioned loosened weaving, the fluffiness of the weft yarn 3*b* of the loose fibriform loops 61 can be further enhanced, thus the mutual restraining function of the front surface 11 and the rear surface 12 can be greatly increased.

As such, according to this embodiment, the mutual restraining function of the front surface and the rear surface is provided by the fabric 1 itself, wherein the first restraining hair 51 provides the restraining function is the horizontal direction, and the second restraining hair 52 provides the restraining function both in the horizontal and the vertical directions, so that the thickness of the fabric 1 can be greatly reduced, and a problem of a conventional pressing sensing bandage not having the adhesion in a moisture environment can be overcome.

Moreover, as long as the two kinds of yarns can both be present on the front surface and the rear surface of the fabric 1 respectively, the fabric 1 can be formed as a fabric structure having the front surface and the rear surface being mutually adhered, for example twill and satin structures can also enable the warp yarn and the weft yarn to be fabricated on opposite surfaces, the above-mentioned is known as prior therefore no further illustration is provided.

Figure 6:
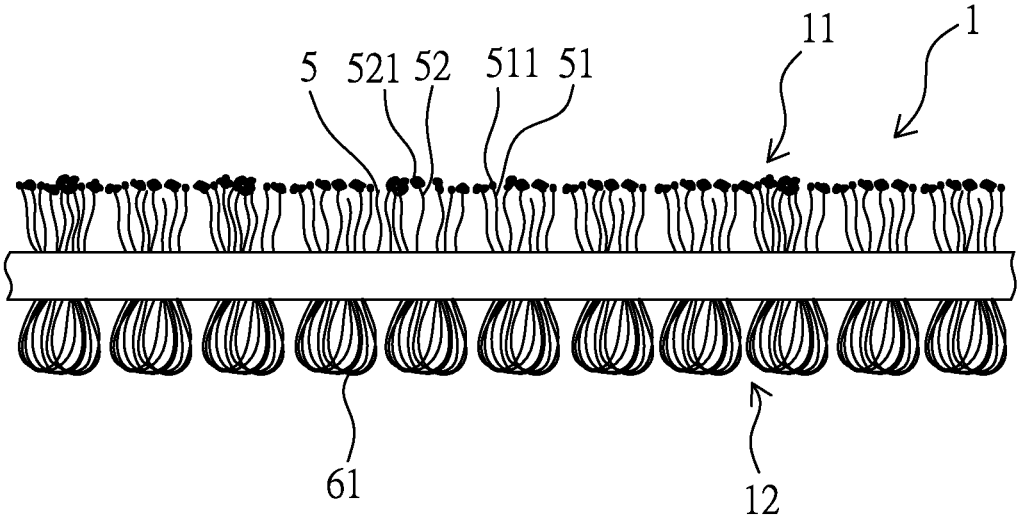
FIG. 6 is a schematic view illustrating a fifth embodiment of the fabric having the restraining function according the present invention, wherein a circular knitted double-surface terry fabric being adopted as the fabric and a front surface thereof being provided with thermoplastic hairs, first restraining hairs and second restraining hairs, and a rear surface being provided with the fibriform loops.

Please refer to FIG. 6, which discloses a fifth embodiment of the fabric having the restraining function according the present invention. According to this embodiment, the fabric 1 is a double-surface terry weaving, circular or warp knitting fabric, and the fabric 1 has a front surface 11 and the rear surface 12; this embodiment is a further application of the third embodiment, and the mutual restraining function is provided after the front surface 11 and the rear surface 12 are in contact. Two surfaces of the fabric 1 are bother formed with a plurality of loops, which are fabricated through thermoplastic filament yarns containing polyester, polyolefin or polyamide, the thermoplastic filament yarns can include thermoplastic filament yarns made of polyester or polyamide with the size of 75 d/35 f, 150 d/36 f or 150 d/48 f, for example the draw texture yarn or thermoplastic fiber air texture yarn.

When being fabricated, the front surface 11 of the fabric 1 is draw texture yarns, and a shearing process is processed for shearing top ends of the loops, so that the front surface 11 of the fabric 1 has hairiness formed with a plurality of erected thermoplastic hairs 5. Then, a singeing process is processed for allowing distal ends of at least a part of the thermoplastic hairs 5 to be melted and cohered for forming a plurality of first restraining hairs 51 having a spherical member and/or a columnar member 511. Lastly, a thermal melting and pressing process is processed for allowing at least of a part of the spherical members and/or the columnar members 511 to be pressed and molded for forming a plurality of second restraining hairs 52 having an irregular deformed member 521, so that the irregular deformed member 521 is able to generate a restraining function with a plurality of the fibriform loops 61.

According to this embodiment, the loops of the rear surface 12 of the fabric 1 can be made of air texture yarns, and also can be made of draw texture yarns; and the base structure of the fabric 1 is added with the elastic filaments, so that the air texture yarns can be more loose due to an elastic returning effect of the elastic filaments, and the covering area of the fibriform loops 61 on the rear surface 12 of the fabric 1 can be increased, thereby increasing the mutual restraining function of the front surface 11 and the rear surface 12.

Based on what has been disclosed above, the surface area of the irregular deformed member 521 of the second restraining hair 52 is larger than that of the thermoplastic hair 5, thus fibriforms having the size similar to the size of the fiber adopted of the front surface 11 can be adopted as the fibriform loops 61, for example 50 d/144 f, 75 d/36 f, 150 d/36 f or 150 d/48 f.

Figure 7:
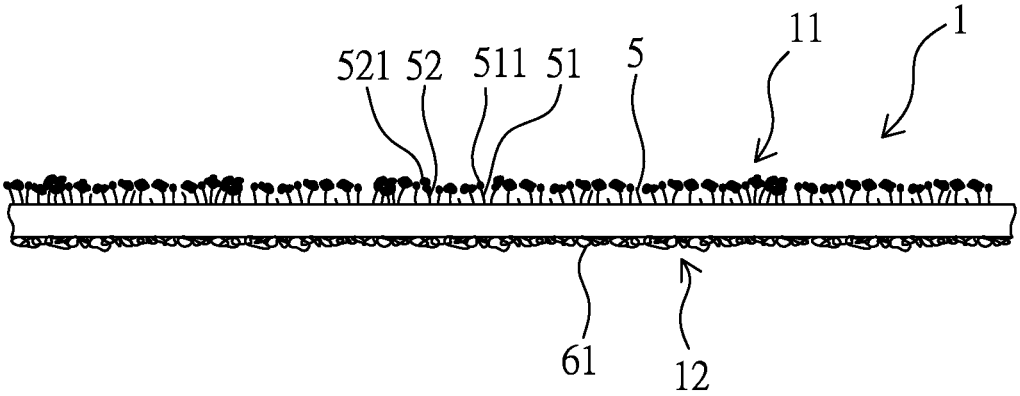
FIG. 7 is a schematic view illustrating a sixth embodiment of the fabric having the restraining function according the present invention, wherein a knitted double-surface fabric being adopted as the fabric and a front surface thereof being provided with thermoplastic hairs, first restraining hairs and second restraining hairs, and a rear surface being provided with the fibriform loops.

Please refer to FIG. 7, which discloses a cross sectional view illustrating a sixth embodiment of the fabric having the restraining function according the present invention. According to this embodiment, the fabric 1 is knitted double-surface fabric, for example PK bird-eye pique fabric. The PK bird-eye pique fabric is able to allow the yarn used for generating the thermoplastic hair 5 and the yarn of the fibriform loops 61 to be respectively fabricated on a front surface 11 and a rear surface 12. The front surface 11 of the fabric 1 is fabricated through thermoplastic filament yarns containing polyester, polyolefin or polyamide, and the thermoplastic filament yarns can be draw texture yarns; according to the aforesaid embodiment, the fabric 1 is processed with a raising finishing process for allowing the front surface 11 of the fabric 1 to have hairiness formed with a plurality of thermoplastic hairs 5. Then, a singeing process is processed for allowing distal ends of at least a part of the thermoplastic hairs 5 to be respectively melted and cohered to form a plurality of the first restraining hairs 51 having a spherical member and/or a columnar member 511. Lastly, a thermal melting and pressing process is processed for allowing at least of a part of the spherical members and/or the columnar members 511 to be pressed and molded for forming a plurality of second restraining hairs 52 having an irregular deformed member 521, so that the irregular deformed member 521 is able to generate a restraining function with a plurality of the fibriform loops 61.

The rear surface 12 of the fabric 1 is provided with a plurality of fibriform loops 61 formed through air texture yarns containing elastic filaments or differential shrinkage yarns having the size of 80 d/156 f, but not limited thereto. According to aforesaid embodiments, with the stretching tension force applied during the elastic filaments being fabricated and the retraction formed through the tension force being released after being dyed and finished, the fibriform loops 61 are able to be more loose and fluffy, thus the front surface and the rear surface of fabric 1 is provided with the mutual restraining function according to this embodiment.

Figure 8:
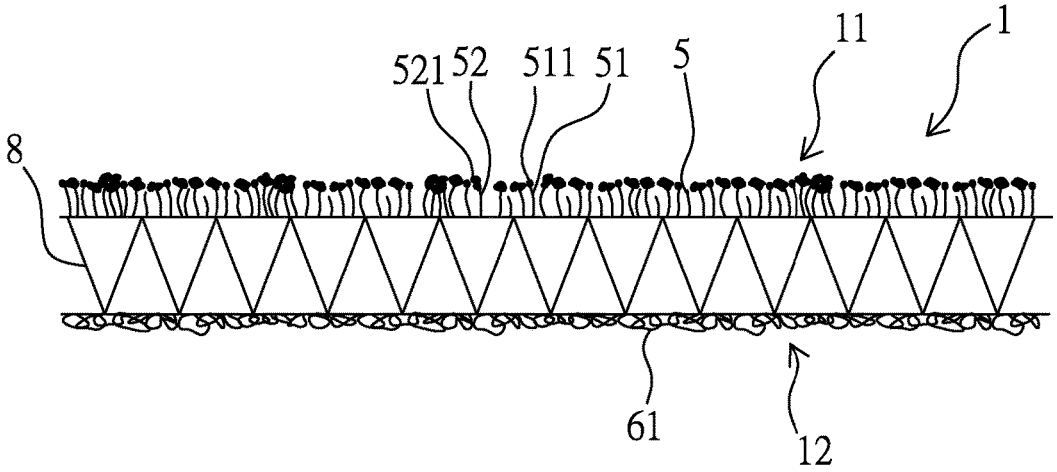
FIG. 8 is a schematic view illustrating a seventh embodiment of the fabric having the restraining function according the present invention, wherein a knitted spacer fabric being adopted as the fabric and a front surface thereof being provided with thermoplastic hairs, first restraining hairs and second restraining hairs, and a rear surface being provided with the fibriform loops.

Please refer to FIG. 8, which discloses a cross sectional view illustrating a seventh embodiment of the fabric having the restraining function according the present invention. According to this embodiment, the fabric 1 is a knitted spacer fabric, so that a front surface 11 and a rear surface 12 of the fabric 1 can be respectively fabricated with two types of yarns, and a connection yarn 8 connecting between the front surface 11 and the rear surface 12 is provided to the fabric 1. Wherein, the yarns emerged from the front surface 11 can be thermoplastic filament yarns containing materials of polyester or polyamide with the size of 150 d/48 f or 150 d/36 f, for example the draw texture yarns, and the thermoplastic filament yarn can be added with elastic filaments in a proper ratio, thereby being provided with the elasticity.

Based on what has been disclosed in the aforesaid embodiments, the fabric 1 is processed with a raising finishing process for allowing the front surface 11 of the fabric 1 to have hairiness formed with a plurality of thermoplastic hairs 5. Then, the singeing process is processed for allowing distal ends of at least a part of the thermoplastic hairs 5 to be respectively melted and cohered to form a plurality of first restraining hairs 51 have a spherical member and/or a columnar member 511. Lastly, a thermal melting and pressing process is processed for allowing at least of a part of the spherical members and/or the columnar members 511 to be pressed and molded for forming a plurality of second restraining hairs 52 having an irregular deformed member 521.

The rear surface 12 is formed with a plurality of fibriform loops 61, yarns used for fabricating the fibriform loops 61 can be made of polyester or polyamide, or can be air texture yarns or draw texture yarns containing elastic filaments, but not limited thereto. According to the aforesaid embodiments, the fibriform loops 61 of the rear surface 12 are fabricated through air texture yarns, for example air texture yarns covering elastic filaments, with the stretching tension force applied during the elastic filaments being fabricated and the retraction formed through the tension force being released after being dyed and finished, fibriform loops erected from a surface of the air texture yarns can be more loose, and the fibriform loops 61 are able to be more loose and puffy. The front surface 11 and the rear surface 12 of fabric 1 is provided with the mutual restraining function, and a problem of a conventional pressing sensing bandage not having the adhesion in a moisture environment can be overcome.

Moreover, according to this embodiment, the more interweaving point between the connection yarn 8 and the front surface 11 and the rear surface 12 of the spacer fabric 1, the less problems of edge fibers falling while the fabric 1 being tailored. Wherein, the connection yarn 8 can be single yarns having a thicker size for increasing the supporting property of the spacer fabric 1 in a thickness direction, or can be conventional thermoplastic filament yarns for reducing the thickness of the spacer fabric 1, or elastic filaments can be added for allowing the spacer fabric 1 being provided with the elasticity in the warn and the weft directions.

Moreover, spacer fabric 1 can be directly tailored by utilizing a cutting tool such as a scissors, and there is no need of a melting and cutting means, for example utilizing an ultrasound cutting machine or a laser cutting machine, so that the tailored edges are soft and there is no hard and rough singed particle generated through the melting and cutting means, and desired length and shape with respect to the requirements of a consumer can be easily provided, and the elasticity in the warp and the weft directions can be provided for greatly increasing the convenience of the product, meanwhile a longitudinal deforming problem of having curved edges while being cut in an long strip shape can be overcome, the tangling effect can be sufficiently provided thereby being the most material applied as a bandage.

Figure 9:
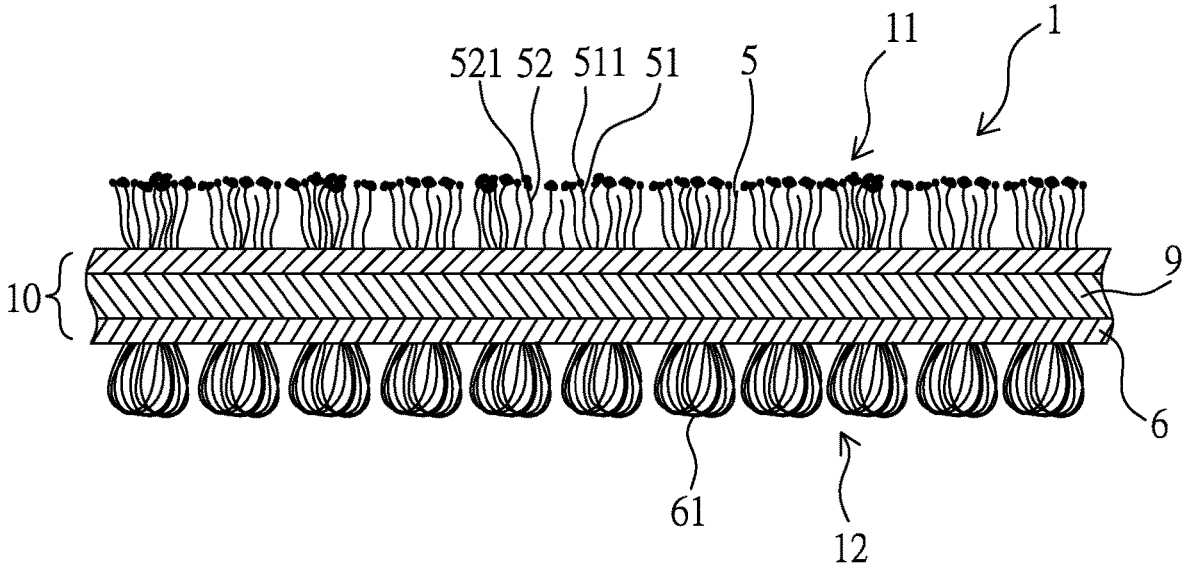
FIG. 9 is a schematic view illustrating an eighth embodiment of the fabric having the restraining function according the present invention, wherein an elastic film being inserted and adhered between the fabric having the restraining function and a fibriform fabric.

Please refer to FIG. 9, which discloses a cross sectional view illustrating an eighth embodiment of the fabric having the restraining function according the present invention. According to this embodiment, an elastic member 9 is inserted and adhered between the fabric 1 and a fibriform loop 6 under an over feeding condition, the elastic member 9 can be a polymer moisture-pervious waterproof film, a polymer air-pervious waterproof film, a Neoprene, or an elastic fabric, thereby forming a fabric combination 10, when the fabric combination is applied as a bandage, the elasticity of the bandage can be increased, thus a longitudinal deforming problem of having curved edges happened in a conventional knitted fibriform fabric can be overcome, and the combination fabric can be applied as a compressing bandage, for example being applied in purpose of compressing varicose veins.

Moreover, according to the aforesaid embodiments, fibers adopted in the thermoplastic filament yarns and the thermoplastic staple yarns can be formed with a plurality of hollow cavities and/or a plurality of micro pores on the surface for enlarging the surface area, so that the fabric 1 is provided with functions of moisture absorbing or fast drying. Meanwhile, the fabric 1 can be further processed with a sanitizing treatment or interwoven with fibers plated with silver, zinc or graphite for allowing the fabric 1 to be provided with an antibacterial function. Besides, the thermoplastic filament yarns can be further combined with metal fibers, for example silver coated fibers, copper fibers or fibers containing graphite, thereby being provided with functions of antistatic and electric conduction.

Besides the sublimation paper printing machine can be adopted as the heating and pressing device, a thermal calendar, a thermal laminator or similar mechanism can also be selected, the heating and contact pressing machine has at least one heating pressing wheel set, the fabric 1 is fed in the heating pressing wheel set for being processed with a continuous thermal melting and pressing process, so that the at least a part of the first restraining hairs 51 having the spherical member and/or the columnar member 511 can be softened, because the pressing wheel sets have metal or silicone surfaces, the second restraining hairs 52 can be respectively pressed for forming an irregular deformed member 521 having a smooth or rough surface.

Based on what has been disclosed above, advantages achieved by the present invention are as follows:

1. The distal ends of the second restraining hairs of the fabric are respectively formed with the irregular deformed member, the irregular deformed member can not only provide the restraining function is the horizontal direction, but also provide the restraining function in the vertical direction; when the fabric is applied as a bandage, the distal end of the bandage is able to be stably adhered and prevented from being easily loosened.
2. The distal ends of the second restraining hairs of the fabric are respectively formed with the irregular deformed member, so that the restraining function can still be provided in a high moisture rate environment.
3. The composed fibers of the fabric is no different from a general clothing fabric, so that the fabric itself is not only a general fabric, but also provides the restraining function in the horizontal direction and in the vertical direction; as such, the fabric can be directly applied as a clothing fabric, a bandage, a wrapping cloth or a fastening tool with the softness of the fabric.
4. The fabric can be formed with the front surface and the rear surface being provided with the mutual restraining function, and woven in the same manner as a cloth, the shape thereof can be freely dyeing, printing and tailoring, and provided with an all-direction restraining function; when the fabric is applied as bandage or a wrapping cloth, the bandage or the wrapping cloth can be freely adhered, so the applicable range is extremely wide.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A fabric having a restraining function and comprising:

at least one yarn having thermoplastic fibers, at least one surface of said fabric having hairiness formed with thermoplastic hairs, first restraining hairs, and second restraining hairs, wherein the first restraining hairs each having a distal end formed with a spherical member and/or a columnar member formed from at least a part of said thermoplastic hairs; and the second restraining hairs each having a distal end formed with an irregular deformed member formed from at least a part of said first restraining hairs, so that said at least one surface of said fabric is able to provide said restraining function in a horizontal direction and in a vertical direction to a plurality of fibriform loops;

wherein a size of each said thermoplastic fibers is smaller than 6 deniers.

2. The fabric having the restraining function as claimed in claim 1, wherein said at least one surface of said fabric is processed with a raising finishing process, including a peaching process and/or a brushing process, for forming said thermoplastic hairs.

3. The fabric having the restraining function as claimed in claim 1, wherein said first restraining hairs having said distal ends formed with said spherical members and/or said columnar members are formed through said thermoplastic hairiness being processed with a singeing process; and said second restraining hairs having said distal ends formed with said irregular deformed members are formed through at least a part of said first restraining hairs being processed with a thermal melting and pressing process.

4. The fabric having the restraining function as claimed in claim 1, wherein said fabric is made from woven fabrics having a plain, a twill, or a spacer structure; or said fabric is made from knitted fabrics having a single-surface, a double-surface, or a spacer structure.

5. The fabric having the restraining function as claimed in claim 1, wherein said thermoplastic hairs are fabricated from hairs formed when staple yarns are processed with a spinning process; and further a raising finishing process, including a peaching process and/or a brushing process, is processed when necessary for fabricating more of said thermoplastic hairs.

6. The fabric having the restraining function as claimed in claim 1, wherein said thermoplastic hairs are formed through a plurality of loops erected on said at least one surface of said fabric being processed with a shearing process.

7. The fabric having the restraining function as claimed in claim 1, wherein said at least one yarn having said thermoplastic fibers has an elastic filament arranged in a warp direction and/or a weft direction, thereby being provided with elasticity.

8. The fabric having the restraining function as claimed in claim 1, wherein said fabric and another fabric having correspondingly-tangled fibriform loops are adhered with a back to back means, so that two opposite surfaces of adhered fabric are provided with a mutual tangling function.

9. The fabric having the restraining function as claimed in claim 8, wherein an elastic member is inserted and adhered between said fabric and said another fabric, thereby forming a fabric combination.

10. The fabric having the restraining function as claimed in claim 9, wherein said elastic member is a polymer moisture-pervious waterproof film, a polymer air-pervious waterproof film, a Neoprene, or an elastic fabric.

11. The fabric having the restraining function as claimed in claim 1, wherein one surface of said fabric has hairiness formed with said second restraining hairs having said distal ends formed with said irregular deformed members, and another surface of said fabric has said fibriform loops, so that said two surfaces of said fabric are provided with a mutual tangling function.

12. The fabric having the restraining function as claimed in claim 1, wherein at least a part of said irregular deformed members are formed when a plurality of said spherical members and/or said columnar members are heated and melted to be cohered.

13. The fabric having the restraining function as claimed in claim 1, wherein said irregular deformed member has a rough surface.

14. The fabric having the restraining function as claimed in claim 1, wherein said irregular deformed member has a smooth surface.

* * * * *